US010384336B2

(12) United States Patent
Grzybowski et al.

(10) Patent No.: US 10,384,336 B2
(45) Date of Patent: Aug. 20, 2019

(54) HYDRAULIC HAMMER ASSEMBLY

(71) Applicant: Caterpillar Inc., Peoria, IL (US)

(72) Inventors: Joshua Grzybowski, Waco, TX (US); Cody Moore, Waco, TX (US)

(73) Assignee: Caterpillar Inc., Deerfield, IL (US)

( * ) Notice: Subject to any disclaimer, the term of this patent is extended or adjusted under 35 U.S.C. 154(b) by 610 days.

(21) Appl. No.: 15/096,384

(22) Filed: Apr. 12, 2016

(65) Prior Publication Data

US 2017/0291290 A1 Oct. 12, 2017

(51) Int. Cl.
*B25D 9/04* (2006.01)
*E21B 1/38* (2006.01)
*E01C 23/12* (2006.01)

(52) U.S. Cl.
CPC ..... *B25D 9/04* (2013.01); *E21C 3/04* (2013.01); *B25D 2209/002* (2013.01); *B25D 2250/051* (2013.01); *B25D 2250/065* (2013.01); *B25D 2250/121* (2013.01); *B25D 2250/125* (2013.01); *B25D 2250/371* (2013.01); *E01C 23/124* (2013.01)

(58) Field of Classification Search
CPC ..... B25D 9/04; E21C 3/04
USPC ..... 173/208
See application file for complete search history.

(56) References Cited

U.S. PATENT DOCUMENTS 3,792,740 A * 2/1974 Cooley ..... B25D 9/145 173/126
4,484,638 A 11/1984 West
4,846,287 A * 7/1989 Ericsson ..... B23B 31/07 173/13
6,095,257 A 8/2000 Lee
6,112,952 A 9/2000 Hess, III et al.
8,672,052 B2 3/2014 Nickels et al.
2002/0134562 A1* 9/2002 Paul ..... B25D 9/04 173/114
2012/0152581 A1 6/2012 Pillers, II et al.
2012/0247839 A1* 10/2012 Kosovich ..... E21B 4/14 175/296
2014/0034159 A1* 2/2014 Myrhum, Jr. ..... F16K 15/18 137/561 R
2014/0102740 A1 4/2014 Jagdale
2014/0208575 A1 7/2014 Jagdale et al.
2014/0332246 A1* 11/2014 Moore ..... B25D 17/24 173/211

(Continued)

FOREIGN PATENT DOCUMENTS

DE 2559331 7/1977
WO 9702385 1/1997

*Primary Examiner* — Michelle Lopez
*Assistant Examiner* — Chinyere J Rushing-Tucker

(57) ABSTRACT

A hydraulic hammer assembly is provided. The hydraulic hammer assembly includes a housing and a piston is arranged for reciprocating movement along a longitudinal axis within the housing. A head disposed along the longitudinal axis on an end of the housing and defines a chamber for holding a pressurized gas. The hydraulic hammer assembly further includes a locking mechanism to lock the head on the housing. The locking mechanism includes at least one first flange extending radially from the end of the housing and at least one second flange extending radially from the head, wherein the head is retained on the housing by blocking axial movement of the second flange against the first flange when in a locked position.

20 Claims, 7 Drawing Sheets

(56) References Cited

U.S. PATENT DOCUMENTS

| | | | | |
|---|---|---|---|---|
| 2017/0282343 | A1* | 10/2017 | Moore | B25D 9/00 |
| 2018/0147708 | A1* | 5/2018 | Grzybowski | B25D 9/04 |

* cited by examiner

HYDRAULIC HAMMER ASSEMBLY

TECHNICAL FIELD

The present disclosure relates to the field of hydraulic hammers. In particular, the present disclosure relates to assembly of hydraulic hammers.

BACKGROUND

Hydraulic hammers are used in work sites to break up large hard objects before such objects can be moved away. Hydraulic hammers can be attached to various machines such as excavators, backhoes, tool carriers, or other like machines for the purpose of milling stone, concrete, and other construction materials. The hydraulic hammer is mounted to a boom of the machine and connected to a hydraulic system. High pressure fluid is then supplied to the hammer to drive a reciprocating piston and a work tool in contact with the piston.

Typically, the hammer assembly is powered by either a hydraulic or pneumatic pressure source. During a work or power stroke, high fluid pressure is applied to a first shoulder of a piston, thereby driving the piston in a forward direction. The piston then strikes a work tool, which is driven in the forward direction thereby causing a work tip of the tool to strike the rock, concrete, asphalt or other hard object to be broken up. During a return stroke, fluid pressure is applied to a second shoulder of the piston in order to return the piston to its original position.

A hydraulic hammer assembly, among other components, typically includes a housing and a head. The housing includes a work tool and a piston that reciprocates in the housing to strike the work tool. The housing may also contain necessary hydraulic circuit to drive the piston in the housing. The head includes, among other components, an accumulator for augmenting the strike power of the piston on the work tool. The accumulators provide for a biasing force to the piston towards the work tool. Generally, such accumulators have a pressurized gas, for example nitrogen, that is contained in a chamber of the head.

U.S. patent publication number US20120152581 discloses a demolition hammer with a head and a housing. In '581, external tie rods are used to tie the front head to the valve body. The tie rods increase the overall diameter of the hammer assembly and add to the complexity of the structure. Tie rods typically have to be replaced at regular service intervals, since they are subject to fatigue and failure. A failure of a tie rod can cause irreparable damage to the entire hammer assembly. Moreover, tie rods in a hammer also increase the overall time required for assembly or disassembly of the hammer. In addition, the disassembly of a hammer with tie rods may require special tools.

SUMMARY OF THE INVENTION

A hydraulic hammer assembly is provided. The hydraulic hammer assembly includes a housing and a piston is arranged for reciprocating movement along a longitudinal axis within the housing. A head disposed along the longitudinal axis on an end of the housing and defines a chamber for holding a pressurized gas. The hydraulic hammer assembly further includes a locking mechanism to lock the head on the housing. The locking mechanism includes at least one first flange extending radially from the end of the housing and at least one second flange extending radially from the head, wherein the head is retained on the housing by blocking axial movement of the second flange against the first flange when in a locked position.

In another aspect, a hydraulic hammer assembly including a housing is provided. The housing is configured for a reciprocating movement of a piston along a longitudinal axis within the housing. The housing has at least one first flange extending radially inwards from an end of the housing. The housing defines an opening adjacent to the first flange relative to the longitudinal axis. A head is positioned on the end of the housing along the longitudinal axis of the housing and the head defines a chamber for holding a pressurized gas. The head has at least one second flange extending radially outwards from the head and the first flange is configured to be received in the end of the housing through the opening, wherein the head is retained on the housing by positioning the second flange axially adjacent to the first flange for blocking movement of the head away from the housing when in a locked position.

In another aspect, a method of assembling a hydraulic hammer is provided. The hydraulic hammer includes a housing configured for reciprocating movement of a piston along a longitudinal axis of the housing and a head is disposed on an end of the housing along the longitudinal axis. The head defines a chamber for holding a pressurized gas and at least one first flange extend radially from the end of the housing. The first flange is positioned at an angle relative to the longitudinal axis. At least one opening is defined on the end of the housing and is positioned at an adjacent angle to the angle relative to the longitudinal axis to receive at least one second flange extending radially from the head. The method includes placing the head on the end of the housing such that the second flange is received in the end of the housing through the opening. The method further includes locking the head on the housing by rotating the head to position the second flange axially adjacent to the first flange.

DETAILED DESCRIPTION

Figure 1:
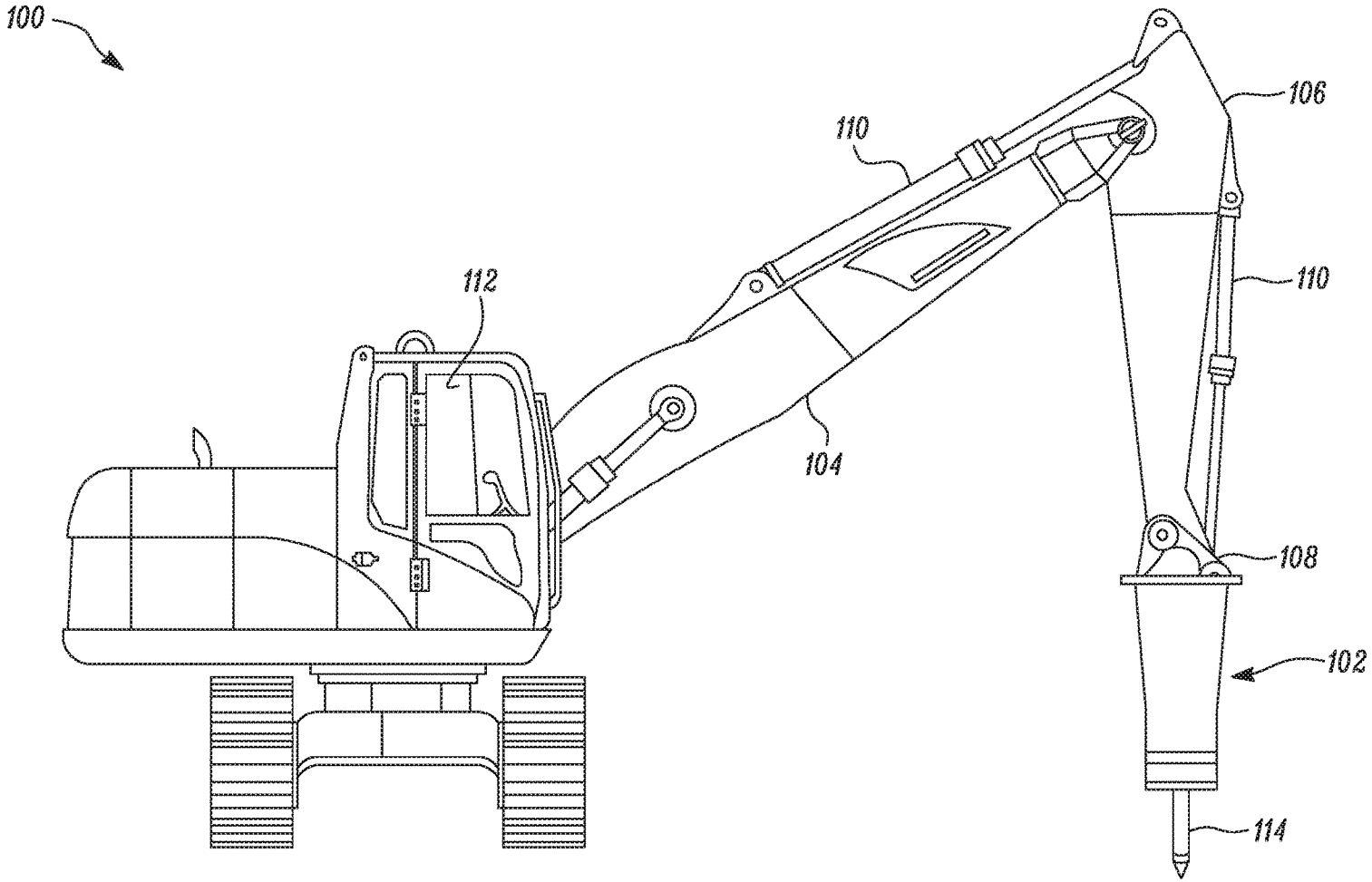
FIG. 1 illustrates schematic diagram of a work machine having a hammer assembly in accordance with an embodiment.

FIG. 1 illustrates an exemplary work machine 100 that may incorporate a hydraulic hammer assembly, hereinafter referred to as a hammer 102. The work machine 100 may be configured to perform work associated with a particular industry such as, mining or construction. For example, work machine 100 may be a backhoe loader, an excavator (shown in FIG. 1), a skid steer loader, or any other machine. The hammer 102 may be coupled to the work machine 100 via a boom 104, an arm 106 and a pivoting bracket 108 that pivotally connects the hammer 102 to the arm 106. It is contemplated that other linkage arrangements known in the art to connect the hammer 102 to the work machine 100 may alternatively be utilized.

In the disclosed embodiment, one or more hydraulic cylinders 110 may raise, lower, and/or swing the boom 104, the arm 106 and the pivoting bracket 108 to correspondingly raise, lower, and/or swing the hammer 102. The hydraulic cylinders 110 may be connected to a hydraulic supply system (not shown) within the work machine 100. Specifically, the work machine 100 may include a hydraulic pump (not shown) connected to the hydraulic cylinders 110 and to the hammer 102 through one or more hydraulic supply lines (not shown). The hydraulic supply system may introduce pressurized fluid, for example oil, from the pump and into the hydraulic cylinders 110. Operator controls for movement of the hydraulic cylinders 110 and/or the hammer 102 may be located within a cabin 112 of the work machine 100.

The hammer 102 includes a work tool 114 that is operated to break rocks and drill ground surfaces. It is contemplated that work tool 114 may include any known tool capable of use with hammer 102. In one embodiment, work tool 114 may include a chisel bit.

Figure 2:
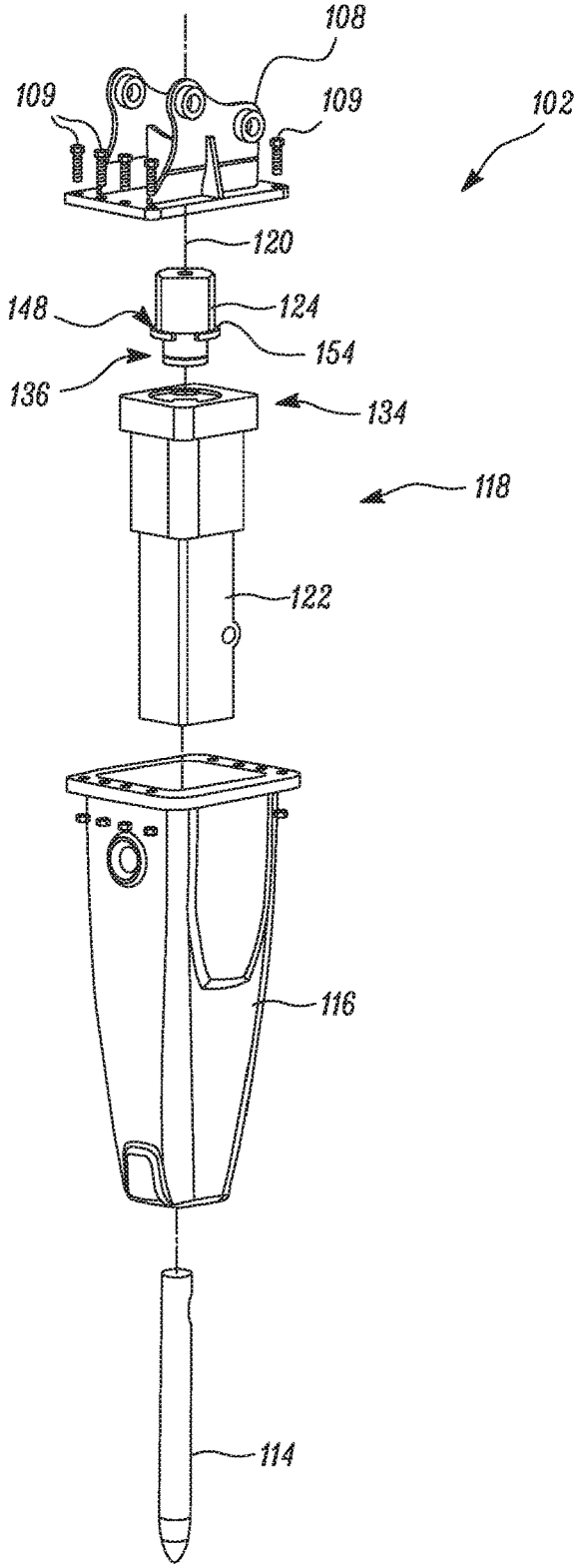
FIG. 2 illustrates a schematic exploded view of the hammer assembly of FIG. 1 in accordance with an embodiment.
Figure 3:
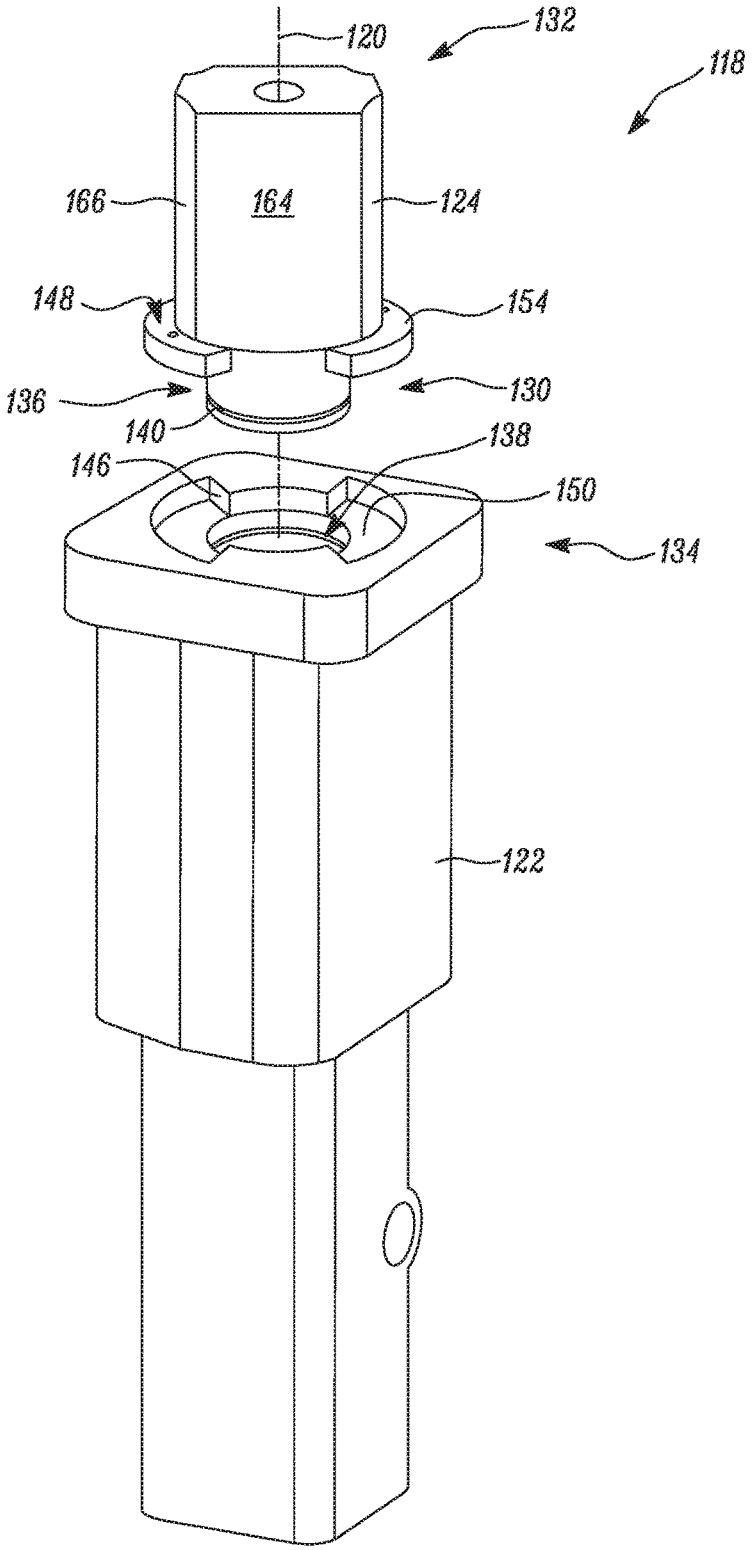
FIG. 3 illustrates a schematic exploded view of a power cell of a hydraulic hammer in accordance with the present disclosure.
Figure 4:
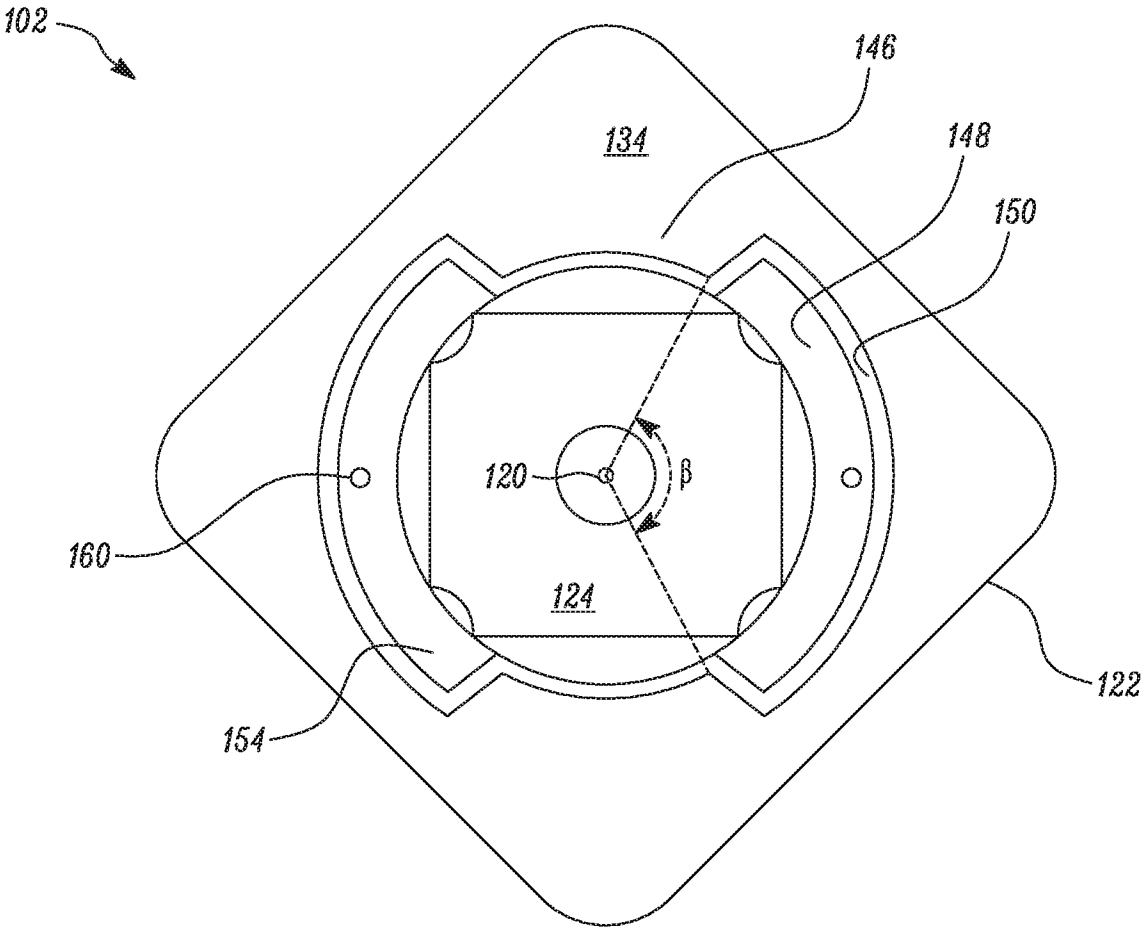
FIG. 4 illustrates a top view of the power cell of FIG. 3 in accordance with an embodiment.
Figure 5:
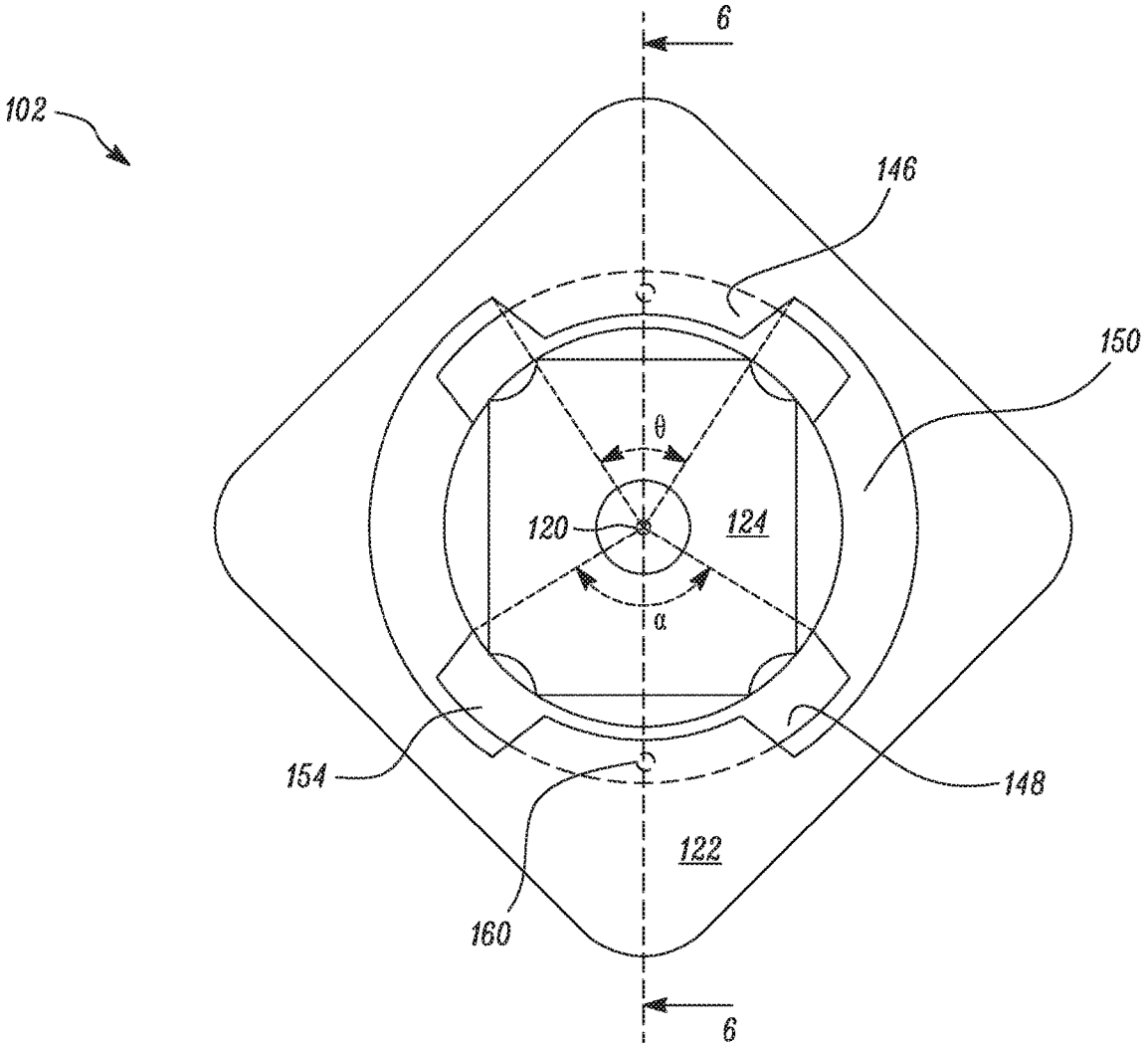
FIG. 5 illustrates a top view of the power cell of FIG. 3 in accordance with an embodiment.

Referring to FIG. 2, the hammer 102 may include an outer shell 116 and a power cell 118 positioned within the outer shell 116. The work tool 114 may be operatively connected to an end of the power cell 118 opposite to the pivoting bracket 108. The pivoting bracket 108 may be connected with the power cell 118 by one or more fasteners 109. Further, the hammer 102 may have a longitudinal axis 120. The power cell 118 is configured to drive the work tool 114 of the hammer 102. It will be apparent to one skilled in the art that various aspects of the hammer 102 and other components may be used in the hammer 102 as required.

As shown in FIGS. 2-6, the power cell 118 may include, among other components, a housing 122 and a head 124. The housing 122 may be a hollow cylindrical body and the head 124 may cap off one end of the housing 122. The power cell 118 may further include a piston 126 (shown in FIG. 6) and a hydraulic circuit (not shown) disposed in the housing 122 with other necessary components for actuating the piston 126 inside the housing 122. The power cell 118, the housing 122, the work tool 114 and the piston 126 may be positioned along the longitudinal axis 120 when the hammer 102 is in an assembled state. The piston 126 may be operatively positioned within the power cell 118 to move along the longitudinal axis 120 for driving the work tool 114. The piston 126 may be configured to reciprocate within both the housing 122 and the head 124 during operation of the hammer 102.

The hammer 102 may be powered by any suitable means, such as pneumatically-powered or hydraulically-powered. For example, a hydraulic or pneumatic circuit may provide pressurized fluid to drive the piston 126 towards the work tool 114 during a work stroke and to return the piston 126 during a return stroke.

Further, the head 124 may define a chamber 128 (shown in FIG. 6) to hold a compressible gas, for example nitrogen. The piston 126 may be slideably move within the chamber 128 to increase or decrease the size of the chamber 128. The chamber 128 may work as an accumulator for augmenting the strike power of the piston 126 against the work tool 114.

As illustrated, the head 124 may have a first end 130 and a second end 132. The first end 130 of the head 124 may be configured to abut the housing 122 and cap-off a top end 134 of the housing 122. In the embodiment as illustrated, the first end 130 has first portion 136 extending from the first end 130 of the head 124. The first portion 136 may be received in a corresponding cavity 138 defined by the top end 134 of the housing 122. Further, the first portion 136 may have an annular groove 140 on an outer peripheral surface 142 for receiving a sealing member 144 to seal any clearance between the first portion 136 of the head 124 and the housing 122, and prevent any leakage of fluid through the clearance.

The hammer 102 may have a locking mechanism to lock the head 124 with the housing 122. Referring to FIGS. 2-6, the locking mechanism may include at least one first flange 146 extending radially from the top end 134 of the housing 122 and at least one second flange 148 extending radially from the first end 130 of the head 124. In the embodiment as illustrated in FIGS. 2-6, the housing 122 has two first flanges 146 positioned diametrically opposite to each other and extending radially inwards relative to the longitudinal axis 120. As illustrated, the first flanges 146 are positioned at an angle $\theta$ relative to the longitudinal axis 120. Further, the head 124 has two second flanges 148 positioned diametrically opposite to each other and extending radially outwards from an outer surface 164 of the first end 130 of the head 124. As illustrated, the second flanges 148 are positioned at an angle $\alpha$ relative to the longitudinal axis 120. The housing 122 may define an opening 150 positioned at a sectorally adjacent angle to the angle $\theta$ of the first flange 146 for receiving the second flange 148 of the head 124. In the embodiment as illustrated, the housing 122 has two openings 150 positioned diametrically opposite to each other and at an angle relative to the longitudinal axis 120.

During assembly of the head 124 over the housing 122, the first end 130 of the head 124 is placed over the top end 134 of the housing 122 along the longitudinal axis 120 with the second flanges 148 axially aligned with the openings 150. The head 124 is then moved towards the housing 122 such that the second flanges 148 enter the top end 134 of the housing 122 through the openings 150 and move past the first flanges 146 in an axial direction. After the second flanges 148 move past the first flanges 146, the head 124 may be rotated by a certain angle about the longitudinal axis 120, to position the head 124 in a locked position. In the locked position, the second flange 148 is positioned axially adjacent to the first flange 146 such that a first axial surface 152 (shown in FIG. 6) of the first flange 146 abuts a second axial surface 154 of the second flange 148 and blocks any movement of the head 124 in a direction axially away from the housing 122 along the longitudinal axis 120.

To unlock the head 124 from the housing 122, the head 124 may be moved to an unlocked position by rotating the head 124 by an angle about the longitudinal axis 120. In the unlocked position, the second flange 148 is positioned axially adjacent to the openings 150 such that on moving the head 124 in an axial direction away from the housing 122, the head 124 can be unmounted from the housing 122. It may be understood that the angle of rotation required for moving the head 124 between the locked position and the unlocked position may depend on the angle of span of the first flange 146 and/or the second flange 148.

Further, it may be understood that the number of the first flanges 146, the second flanges 148 and the openings 150 may be chosen based on different design requirements. In the embodiment as illustrated, two first flanges 146 and two second flanges 148 are shown. In an alternate embodiment, a plurality of first flange 146 and second flanges 148 may be used based on different design requirement. Further, the first flange 146 and the second flange 148 are shown as integral to the housing 122 and the head 124, respectively. It may be understood that in an alternate embodiment the first flange 146 and the second flange 148 may be a separate components attached to the housing 122 and the head 124, respectively.

Figure 6:
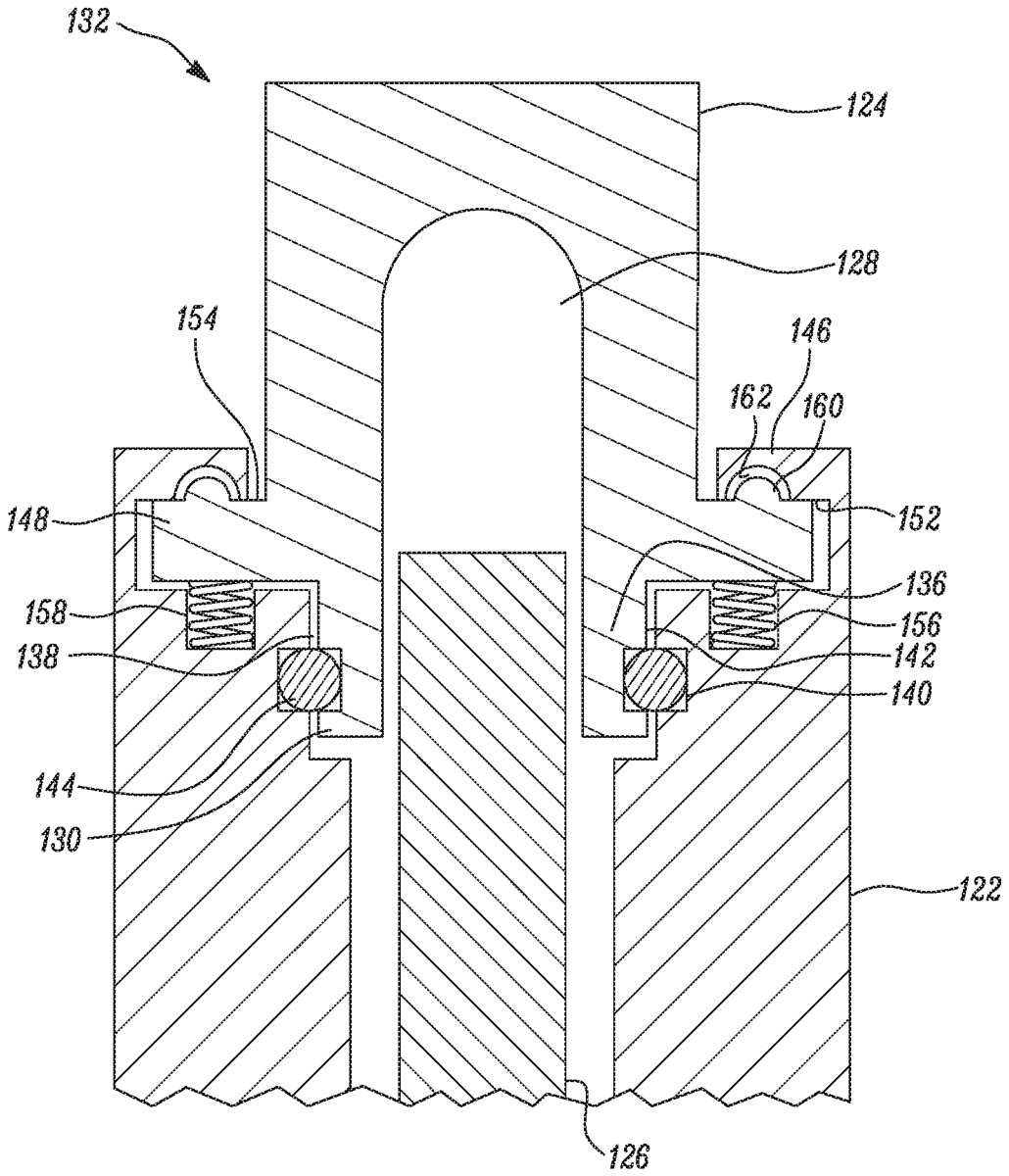
FIG. 6 illustrates a partial schematic cross-section view of the power cell along the line 6-6 of FIG. 5 in accordance with an embodiment.

Further, in an embodiment, the locking mechanism may include a biasing member. The biasing member may be configured to bias the head 124 in a direction axially away from the housing 122. As illustrated in FIG. 6, a spring 156 is configured to bias the second flange 148 of the head 124 away from the housing 122. The spring 156 is positioned in a receptacle 158 defined in the housing 122, such that a portion of the spring 156 is positioned outside the receptacle 158 to establish contact with the second flange 148 when the head 124 is moved to the locked position. The spring 156 is thus configured to keep the head 124 in a locked position by biasing the second flange 148 towards the first flange 146 for retaining the head 124 in the locked position. It may be understood that any other biasing mechanism known in the art may be used to perform a similar function as performed by the spring 156.

In an embodiment, the locking mechanism may include a detent mechanism to retain the head 124 in the locked position. In the embodiment as illustrated in FIGS. 2-6, a projection 160 is positioned on the first axial surface 152 of the second flange 148 and a detent 162 is positioned on the first axial surface 152 of the first flange 146. The projection 160 and the detent 162 are positioned such that in the locked position the projection 160 is received in the detent 162 to retain the head 124 into the locked position. In an embodiment, the detent mechanism may be configured to provide a tactile or a sound feedback of the head 124 entering into and/or out of the locked position. The biasing member and the detent mechanism may work in conjunction to retain the head 124 in the locked position.

In the present embodiment, the first flange 146 and the second flange 148 are shown extending radially along a plane perpendicular to the longitudinal axis 120. It may be understood that in an alternate embodiment, the first flange 146 and/or the second flange 148 may extend radially along a plane positioned at an angle relative to the longitudinal axis 120. Further, the first flange 146 is shown extending radially inwards from the housing 122 and the second flange 148 is shown extending radially outwards from the head 124. In an alternate embodiment, the first flange 146 may extend radially outwards from the housing 122 and the second flange 148 may extend radially inwards from the head 124. Further, it may be understood that the first flange 146 and the second flange 148 may have size and dimensions based on different design requirements of the hammer assembly.

The outer surface 164 at the second end 132 of the head 124 may be configured for gripping the head 124 manually with a hand for mounting or unmounting the head 124 from the housing 122. In the embodiment as illustrated, the second end 132 of the head 124 has a non-circular cross section and has recessed portions 166 on the outer surface 164. The non-circular cross section along with the recessed portions may provide for a sufficient grip for manually mounting or unmounting the head 124 using a hand. It may be understood that alternate configurations on the head 124 may be utilized for providing an effective hand-grip of the head 124 such that the head 124 may be mounted or unmounted with need of any special tool or fixture. For example, in an embodiment the head 124 may have a ribbed outer surface 164 for providing effective hand-grip on the head 124.

INDUSTRIAL APPLICABILITY

The present disclosure provides for a hammer assembly that is easy to assemble or disassemble. The head 124 of the hammer 102 in accordance with the present disclosure may be disassemble manually with use of hands, and thus eliminating requirement of any special tools or fixtures.

Further, the present disclosure provides for a simplified construction of the hammer 102. The conventionally used tie rods increase the overall diameter of the hammer 102 and add to the complexity of the structure. In addition, the tie rods typically have to be replaced at regular service intervals, since they are subject to fatigue and failure. The hammer 102 of the present disclosure eliminates need of tie rods to mount the head 124 on the housing 122, and thus provides for a compact hammer assembly with improved serviceability. The hammer 102 in accordance with the present disclosure may also reduce the downtime associated with the hammer 102 by decreasing overall time required for servicing or repairing of the hammer 102.

Figure 7:
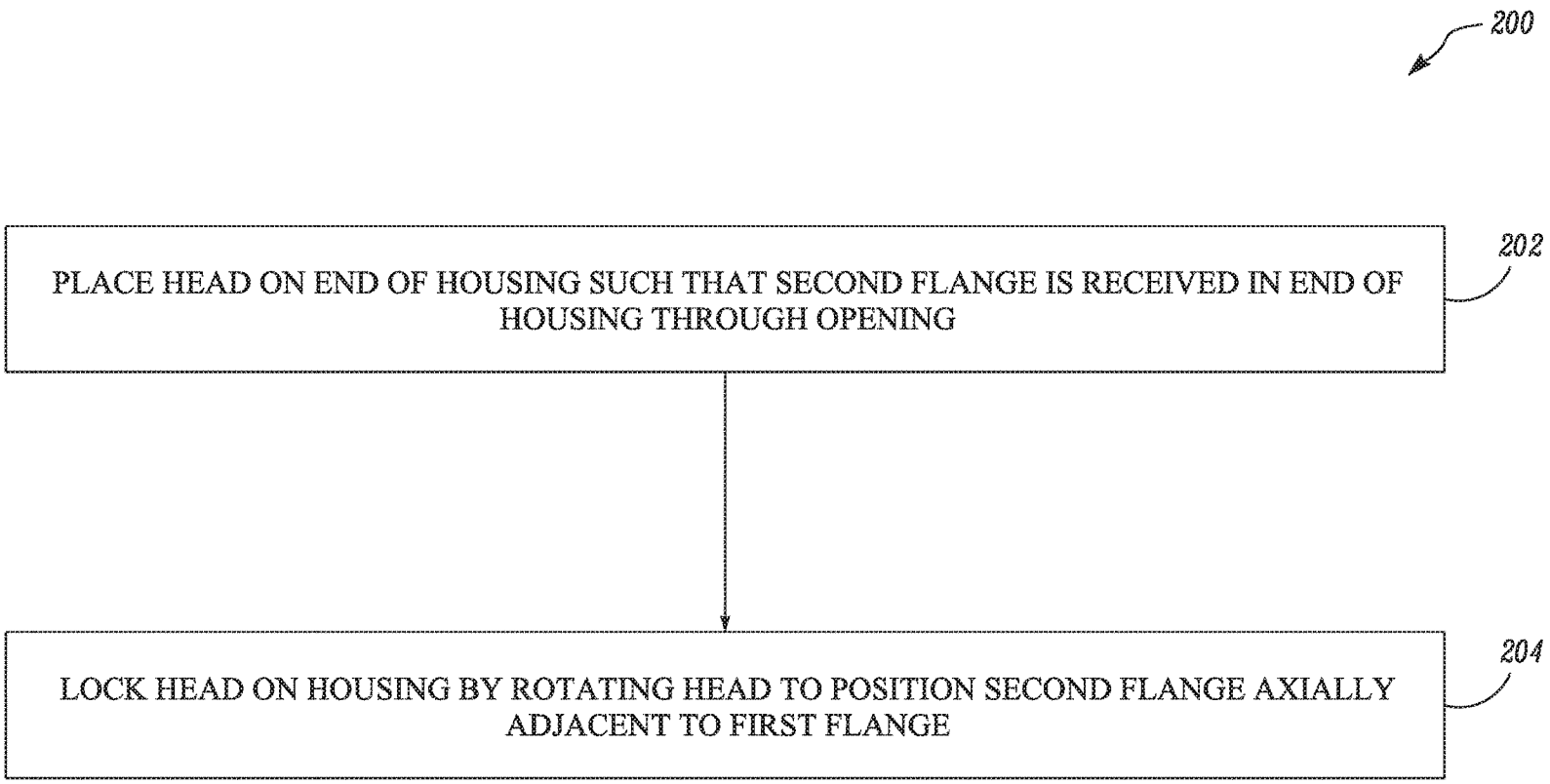
FIG. 7 illustrates a method of assembling a hammer.

The present disclosure further provides for a method 200 of assembly of a hammer 102. Referring to FIG. 7, the method 200 may include a step 202 of placing the head 124 on the end of the housing 122 such that the second flange 148 is received in the end of the housing 122 through the opening 150. For assembly of the hammer 102, the head 124 may be placed along the longitudinal axis 120 with the second flange 148 aligned axially with the opening 150. Then the head 124 may be moved in an axial direction towards the housing 122 such that the second flange 148 is received in the top end 134 of the housing 122 through the opening 150 till the second flange 148 move past the first flange 146 in an axial direction.

Further, the method 200 may include a step 204 of locking the head 124 on the housing 122 by rotating the head 124 to position the second flange 148 axially adjacent to the first flange 146. After the second flange 148 moves past the first flange 146, the head 124 may be rotated about the longitudinal axis 120 such that the second flange 148 is positioned axially adjacent to the first flange 146. In the locked position the first axial surface 152 may abut the first axial surface 152 such that the first flange 146 blocks any movement of the second flange 148 in an axial direction.

Further, the method 200 may include locking the head 124 on the housing 122 by a detent 162 on one of the first flange 146 and the second flange 148 and a projection 160 for engaging the detent 162 on the other of the first flange 146 and the second flange 148. In the embodiment as illustrated in FIGS. 3-6, the detent 162 is provided on the first axial surface 152 and the projection 160 is provided on the first axial surface 152. The detent 162 and the projection 160 are positioned such that when the head 124 moves in the locked position, the projection 160 is received in the detent 162 to retain the head 124 in the locked position.

The method 200 may further include unlocking the head 124 from the housing 122 by rotating the head 124 to position the second flange 148 axially adjacent to the opening 150. To unlock the head 124 from the housing 122, for example while a service or a repair, the head 124 may be rotated to position the head 124 in the unlocked position. In the unlocked position, the first flange 146 is positioned axially adjacent to the opening 150 such that the second flange 148 may move through the opening 150 and allowing the head 124 to move in an axial direction away from the housing 122.

The present disclosure provides for a simplified construction of the components of the hammer 102. The conventional hammer assemblies with tie rods may require aligned bores in the head 124 and the housing 122 to receive the tie rods, and thus may increase over all time and cost in machining during manufacturing such components. The hammer 102 in accordance with the present disclosure requires a first flange 146 and a second flange 148 which may be built integrally with the housing 122 eliminating need for drilling any aligned bores in the head 124 or the housing 122 for assembling the head 124 and the housing 122. Thus, the hammer 102 in accordance with the present disclosure may be time saving and cost effective.

What is claimed is:

1. A hydraulic hammer assembly comprising:

a housing;

a piston arranged for reciprocating movement along a longitudinal axis within the housing;

a head disposed along the longitudinal axis on an end of the housing and defining a chamber for holding a pressurized gas; and a locking mechanism to lock the head on the housing, the locking mechanism comprising:

at least one first flange extending radially from the end of the housing; and at least one second flange extending radially from the head, wherein the head is rotatable relative to the housing between a locked position and an unlocked position, wherein the head is retained on the housing by blocking axial movement of the at least one second flange against the at least one first flange when in the locked position, and wherein the head is free to disengage from the housing along the longitudinal axis when the head is located in the unlocked position relative to the housing.

2. The hydraulic hammer assembly of claim 1, further comprising a biasing member disposed between the head and the housing, the biasing member being configured to bias the at least one second flange along the longitudinal axis into contact with the at least one first flange.

3. The hydraulic hammer assembly of claim 2, wherein the biasing member is a spring.

4. The hydraulic hammer assembly of claim 1, wherein the housing defines at least one opening adjacent to the at least one first flange to receive the at least one second flange in the end of the housing through the at least one opening in the unlocked position.

5. The hydraulic hammer assembly of claim 4, wherein when the head is in the locked position relative to the housing, the at least one second flange is positioned axially adjacent to the at least one first flange, and when the head is in the unlocked position relative to the housing, the at least one second flange is positioned axially adjacent to the at least one opening.

6. The hydraulic hammer assembly of claim 5, further comprising a detent on one of the at least one first flange and the at least one second flange and a projection for engaging the detent on the other of the at least one first flange and the at least one second flange for retaining the head in the locked position.

7. The hydraulic hammer assembly of claim 4, wherein the at least one first flange includes a pair of first flanges positioned diametrically opposite to each other within a plane perpendicular to the longitudinal axis on the end of the housing, and the at least one opening includes a pair of openings positioned diametrically opposite to each other within the plane perpendicular to the longitudinal axis on the end of the housing.

8. The hydraulic hammer assembly of claim 1, wherein the at least one first flange extends radially inward from the end of the housing and the at least one second flange extends radially outward from the head.

9. The hydraulic hammer assembly of claim 1, wherein the head has a first end extending from the chamber and configured to be received in the end of the housing.

10. The hydraulic hammer assembly of claim 9, wherein a sealing member seals a clearance between the first end of the head and the end of the housing.

11. A hydraulic hammer assembly comprising:

a housing configured for a reciprocating movement of a piston along a longitudinal axis within the housing, the housing having at least one first flange extending radially inward from an end of the housing, the housing defining at least one opening adjacent to the at least one first flange relative to the longitudinal axis; and a head positioned on the end of the housing along the longitudinal axis of the housing and defining a chamber for holding a pressurized gas, the head having at least one second flange extending radially outward from the head and configured to be received in the end of the housing through the at least one opening, wherein the head is rotatable relative to the housing between a locked position and an unlocked position, wherein the head is retained on the housing by positioning the at least one second flange axially adjacent to the at least one first flange for blocking movement of the head away from the housing along the longitudinal axis when in the locked position, and wherein the head is free to disengage from the housing along the longitudinal axis when the head is located in the unlocked position relative to the housing.

12. The hydraulic hammer assembly of claim 11, further comprising a biasing member disposed between the head and the housing, the biasing member being configured to bias the at least one second flange along the longitudinal axis into contact with the at least one first flange.

13. The hydraulic hammer assembly of claim 11, wherein when the head is in the locked position relative to the housing having the at least one second flange is positioned axially adjacent to the at least one first flange, and when the head is in the unlocked position relative to the housing the at least one second flange is positioned axially adjacent to the at least one opening.

14. The hydraulic hammer assembly of claim 11, the hydraulic hammer assembly further comprising a detent on one of the at least one first flange and the at least one second flange and a projection for engaging the detent on the other of the at least one first flange and the at least one second flange for retaining the head in the locked position.

15. The hydraulic hammer assembly of claim 11, wherein the at least one first flange includes a pair of first flanges positioned diametrically opposite to each other within a plane perpendicular to the longitudinal axis on the end of the housing, and the at least one opening includes a pair of openings positioned diametrically opposite to each other within the plane perpendicular to the longitudinal axis on the end of the housing.

16. The hydraulic hammer assembly of claim 11, wherein the head has a first end extending from the chamber and configured to be received in the end of the housing.

17. The hydraulic hammer assembly of claim 16, wherein a sealing member seals a clearance between the first end of the head and the end of the housing.

18. A method for assembling a hydraulic hammer, the hydraulic hammer comprising a housing configured for reciprocating movement of a piston along a longitudinal axis of the housing and a head disposed on an end of the housing along the longitudinal axis, the head defining a chamber for holding a pressurized gas, at least one first flange extending radially from the end of the housing and positioned at an angle relative to the longitudinal axis, at least one opening defined on the end of the housing and positioned at an adjacent angle to the angle relative to the longitudinal axis to receive at least one second flange extending radially from the head, the method comprising:

placing the head on the end of the housing such that the at least one second flange is received in the end of the housing through the at least one opening; and locking the head on the housing by rotating the head to position the at least one second flange axially adjacent to the at least one first flange.

19. The method of claim 18, further comprising locking the head on the housing by a detent on one of the at least one first flange and the at least one second flange and a projection for engaging the detent on the other of the at least one first flange and the at least one second flange.

20. The method of claim 19, further comprising unlocking the head from the housing by rotating the head to position the at least one second flange axially adjacent to the at least one opening.

* * * * *